US008661837B2

(12) United States Patent
Kakita et al.

(10) Patent No.: US 8,661,837 B2
(45) Date of Patent: Mar. 4, 2014

(54) REFRIGERATOR

(75) Inventors: Kenichi Kakita, Shiga (JP); Toshiaki Mamemoto, Shiga (JP); Yoshihiro Ueda, Nara (JP); Satomi Ueda, legal representative, Nara (JP)

(73) Assignee: Panasonic Corporation, Osaka (JP)

( * ) Notice: Subject to any disclaimer, the term of this patent is extended or adjusted under 35 U.S.C. 154(b) by 199 days.

(21) Appl. No.: 13/389,568

(22) PCT Filed: Aug. 24, 2010

(86) PCT No.: PCT/JP2010/005195
§ 371 (c)(1),
(2), (4) Date: Feb. 23, 2012

(87) PCT Pub. No.: WO2011/024438
PCT Pub. Date: Mar. 3, 2011

(65) Prior Publication Data

US 2012/0137711 A1 Jun. 7, 2012

(30) Foreign Application Priority Data

Aug. 26, 2009 (JP) ..... 2009-194953

(51) Int. Cl.
*F25D 17/06* (2006.01)

(52) U.S. Cl.
USPC ..... 62/91; 62/158

(58) Field of Classification Search
USPC ..... 62/91, 158, 126, 187, 255, 440, 304; 239/690, 691
See application file for complete search history.

(56) References Cited

U.S. PATENT DOCUMENTS

| | | | | |
|---|---|---|---|---|
| 2,829,504 | A * | 4/1958 | Schlichtig | 62/196.1 |
| 3,469,785 | A * | 9/1969 | Tobin et al. | 239/4 |
| 4,827,867 | A * | 5/1989 | Takei et al. | 118/64 |
| 6,629,422 | B2 * | 10/2003 | Wellman | 62/155 |
| 8,196,417 | B2 * | 6/2012 | Kim et al. | 62/78 |
| 8,316,673 | B2 * | 11/2012 | Lee et al. | 68/3 R |
| 2009/0217694 | A1 * | 9/2009 | Kim et al. | 62/426 |
| 2010/0147003 | A1 | 6/2010 | Ueda et al. | |
| 2010/0236269 | A1 | 9/2010 | Mamemoto et al. | |

FOREIGN PATENT DOCUMENTS

| | | |
|---|---|---|
| JP | 6-257933 | 9/1994 |
| JP | 2006-150334 | 6/2006 |
| JP | 2007-046888 | 2/2007 |
| JP | 2007-046891 | 2/2007 |
| JP | 2007-054808 | 3/2007 |
| JP | 2009-002587 | 1/2009 |
| SU | 1307185 | 4/1987 |
| WO | 2008/139706 | 11/2008 |
| WO | 2009/060593 | 5/2009 |

* cited by examiner

*Primary Examiner* — Mohammad M Ali
(74) *Attorney, Agent, or Firm* — Hamre, Schumann, Mueller & Larson, P.C.

(57) ABSTRACT

To maintain an appropriate humidity in a refrigerator using a spray device to spray mist, without depending on a moisture sensor. A refrigerator (100) for forcibly circulating cold air which is gas cooled in a cooling compartment (110), the refrigerator including: a first storage compartment (107) disposed on the way of an air passage; a spray device (131) which sprays mist into the first storage compartment (107); a damper (145) disposed upstream of the first storage compartment (107); a delay unit (156) which generates, based on an open signal issued when the damper (145) is opened, a first signal for stopping the operation of the spray device (131) after an elapse of a first time period, and to generate, based on a close signal issued when the damper (145) is closed, a second signal for starting the operation of the spray device (131) after an elapse of a second time period; and a control unit (146) which controls the spray device (131).

15 Claims, 6 Drawing Sheets

REFRIGERATOR

TECHNICAL FIELD

The present invention relates to a refrigerator in which a spray device is installed to a storage space for vegetables and the like.

BACKGROUND ART

Influential factors for deterioration of freshness of vegetables include temperature, humidity, ambient gas, microorganisms, and light. Because respiration and transpiration occur on the surfaces of vegetables, in order to maintain the freshness of vegetables, it is necessary to reduce respiration and transpiration to a low level. Except for some vegetables susceptible chilling damage, respiration of most vegetables is reduced at a low temperature, and transpiration can be prevented in high humidity.

In recent years, household refrigerators are provided with a sealed dedicated container for the purpose of preserving vegetables, where vegetables are cooled to an appropriate temperature, and the humidity in the refrigerator is increased so as to keep transpiration from vegetables under control. Here, there is known a spray device for spraying mist as a unit to increase the humidity in the refrigerator.

As a refrigerator provided with spraying capability of this type, there is a refrigerator, in which a spray device humidifies the space in a vegetable compartment so as to keep transpiration from vegetables under control by spraying mist with an ultrasonic atomizing device when the vegetable compartment is at a low temperature (for example, see Patent Literature 1).

FIG. 6 is a vertical sectional view of the conventional refrigerator described in Patent Literature 1, and FIG. 7 is a principal enlarged perspective view of an ultrasonic atomizing device provided in the vegetable compartment of the conventional refrigerator.

As shown in FIG. 6, a vegetable compartment 21 is provided in the lower portion of a body case 26 of a refrigerator body 20, and the front opening of the vegetable compartment 21 is designed to be closed by a drawer door 22, which may be drawn in a freely openable and closable manner. The vegetable compartment 21 is partitioned from the upper refrigerator compartment (not shown) by a partition plate 2. A fixing hanger 23 is fixed to the inner surface of the drawer door 22, and a vegetable container 1 which stores food such as vegetables is mounted on the fixing hanger 23. The top opening of the vegetable container 1 is sealed by a lid 3. The inside of the vegetable container 1 is provided with a thaw compartment 4, and the rear surface of the thaw compartment 4 is provided with an ultrasonic atomizing device 5.

As shown in FIG. 7, the ultrasonic atomizing device 5 includes a mist diffuser 6, a water storage container 7, a humidity sensor 8, and a hose receiver 9. The water storage container 7 is connected to a defrost water hose 10 via the hose receiver 9. A portion of the defrost water hose 10 is provided with a cleaning filter 11 for cleaning defrost water.

Hereinafter, the operation of the refrigerator as configured in this manner is described.

First, cooling air cooled by a heat exchange cooler (not shown) circulates along the outer surface of the vegetable container 1 and a lid 3 so that the vegetable container 1 is cooled, and thus the food stored therein is cooled. The defrost water generated from the heat exchange cooler when the refrigerator is in operation is cleaned by the cleaning filter 11 as passing through the defrost water hose 10, and is supplied to the water storage container 7 of the ultrasonic atomizing device 5.

Next, when the humidity in the refrigerator is detected to be 90% or less by the humidity sensor 8, the ultrasonic atomizing device 5 starts to humidify the inside of the refrigerator and controls the humidity to an appropriate level in order to keep the vegetables in the vegetable container 1 fresh. On the other hand, when the humidity in the refrigerator is detected to be 90% or more by the humidity sensor 8, the ultrasonic atomizing device 5 stops excessive humidification. Consequently, the inside of the vegetable compartment 21 is kept in the most appropriate humidity state by the ultrasonic atomizing device 5.

CITATION LIST

Patent Literature

[PTL 1]
Japanese Unexamined Patent Application Publication No. 6-257933

SUMMARY OF INVENTION

Technical Problem

However, in the above-described conventional configuration, start and stop of the atomizing device is generally controlled based on the refrigerator's humidity detected by the humidity sensor. With this mechanism, precision or responsiveness of the detection may cause a problem. In this case, because the humidity in the refrigerator cannot be obtained accurately, there is a problem in that a degree of forced humidification could be too much or too less. Particularly, in a storage compartment of the refrigerator, i.e., substantially sealed, low temperature space, an excessive amount of atomization causes water rot of vegetables and the like, and condensation forms in the refrigerator. On the other hand, a smaller amount of atomization causes an insufficient humidification of the storage compartment, and thus vegetables and the like cannot be kept fresh.

The present invention solves the above-described existing problems, and it is an object of the invention to provide a refrigerator capable of maintaining the humidity more appropriately and efficiently without depending on a humidity sensor, provided that the refrigerator is equipped with an atomizing unit to increase freshness keeping ability by spraying mist.

Solution to Problem

In order to solve the above-described existing problem, a refrigerator according to one aspect of the present invention provides a refrigerator for circulating cold air which is a gas cooled in a cooling compartment, the refrigerator including: a storage compartment partitioned with heat insulation; a spray device configured to supply mist to the storage compartment; a damper provided in an air passage for circulating the cold air from the cooling compartment to the storage compartment; a control unit configured to control the spray device so that an operation of the damper and an operation of the spray device are coordinated; and a delay unit configured to command the control unit to stop the operation of the spray device after an elapse of a first time period since the damper is opened.

In addition, one aspect of the present invention provides a refrigerator for circulating cold air which is a gas cooled in a cooling compartment, the refrigerator including: a storage compartment partitioned with heat insulation; a spray device configured to supply mist to the storage compartment; a damper provided in an air passage for circulating the cold air from the cooling compartment to the storage compartment; a control unit configured to control the spray device so that an operation of the damper and an operation of the spray device are coordinated; and a delay unit configured to command the control unit to start the operation of the spray device after an elapse of a second time period since the damper is closed.

This configuration allows an atomizing unit to efficiently spray mist and to appropriately humidify the inside of the storage compartment.

Advantageous Effects of Invention

The refrigerator of the present invention not only achieves appropriate and efficient atomization to improve the quality of itself provided with an atomization device, but also the amount of power required to control the atomizing device can be reduced to a minimum.

DESCRIPTION OF EMBODIMENTS

Figure 1:
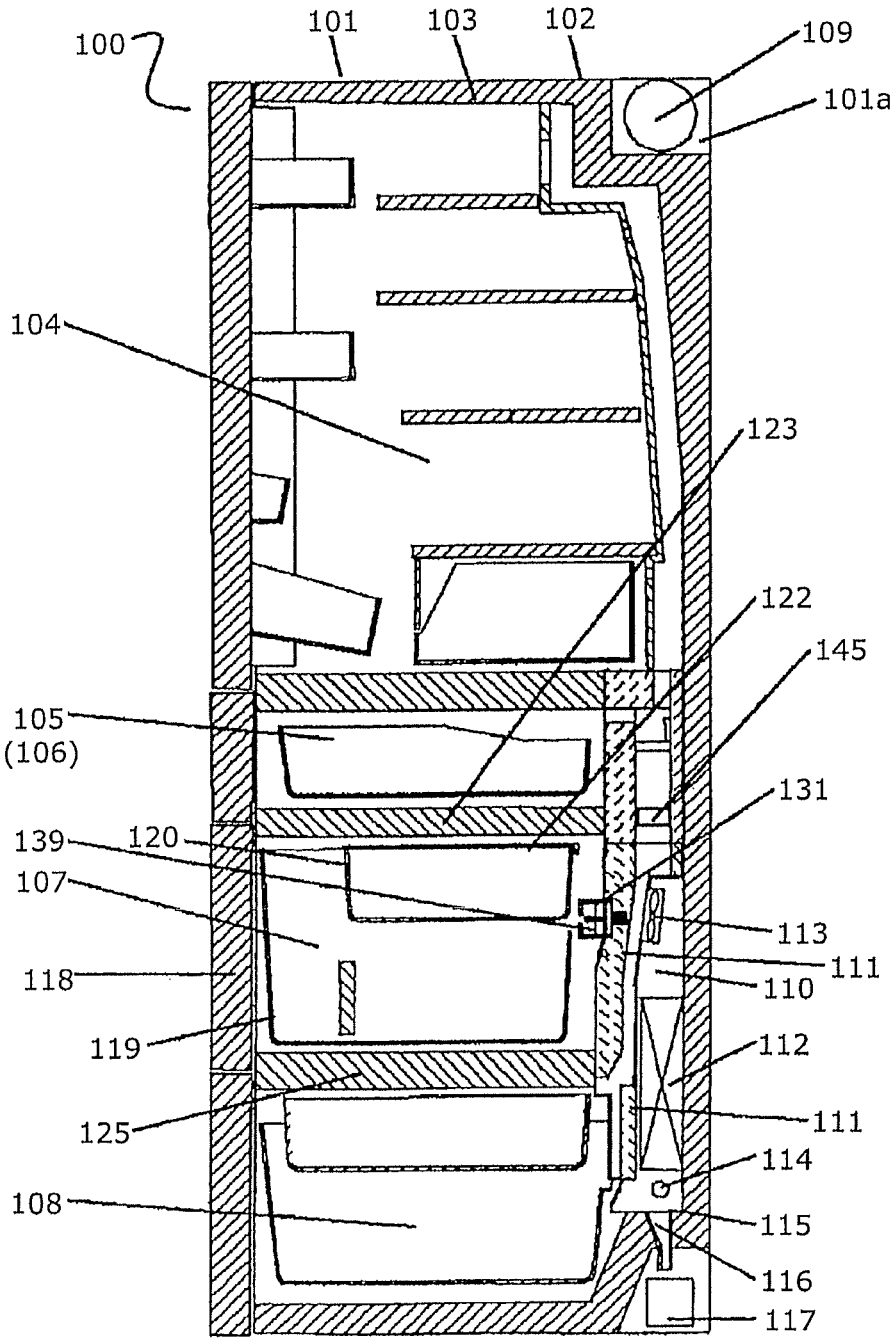
FIG. 1 is a vertical sectional view of a refrigerator in Embodiment 1 of the present invention.

A first aspect of the invention provides a refrigerator according to one aspect of the present invention provides a refrigerator for circulating cold air which is a gas cooled in a cooling compartment, the refrigerator including: a storage compartment partitioned with heat insulation; a spray device configured to supply mist to the storage compartment; a damper provided in an air passage for circulating the cold air from the cooling compartment to the storage compartment; a control unit configured to control the spray device so that an operation of the damper and an operation of the spray device are coordinated; and a delay unit configured to command the control unit to stop the operation of the spray device after an elapse of a first time period since the damper is opened.

A second aspect of the invention provides a refrigerator for circulating cold air which is a gas cooled in a cooling compartment, the refrigerator including: a storage compartment partitioned with heat insulation; a spray device configured to supply mist to the storage compartment; a damper provided in an air passage for circulating the cold air from the cooling compartment to the storage compartment; a control unit configured to control the spray device so that an operation of the damper and an operation of the spray device are coordinated; and a delay unit configured to command the control unit to start the operation of the spray device after an elapse of a second time period since the damper is closed.

The atomizing unit is controlled according to the timing of opening and closing of the damper when the flow of cold air is changed, the flow air flow governing occurrences of condensation and drying in the periphery of the atomizing unit. Therefore, an atomizing operation can be performed in the most suitable state for atomization, and thus an atomizing device which has an efficient mist spraying function and an excellent energy-saving feature can be mounted on a refrigerator.

A third aspect of the invention further includes a condensation prevention heater configured to dry a periphery of the spray device by heating, wherein the control unit is configured to cause the condensation prevention heater to operate for a predetermined drying period until the close signal is received when the damper is in a closed state and the spray device is in operation based on the close signal and the second signal.

Accordingly, unnecessary energization of the condensation prevention heater is not performed when the periphery of the atomizing unit is already dry because of subsequent atomizing operation, and thus, not only power consumption can be reduced, but also an increase of the temperature in the storage compartment can be reduced.

According to a fourth aspect of the invention, the spray device includes: a thin rod-shaped atomizing electrode; a counter electrode which is disposed so as to oppose and be spatially apart from the atomizing electrode; and a voltage applying unit configured to apply a voltage across the atomizing electrode and the counter electrode with the atomizing electrode at a negative potential and the counter electrode at a reference potential.

The voltage to be applied can be reduced to a lower level, and thus miniaturization of the atomizing device can be achieved.

Hereinafter, an embodiment of the present invention is described with reference to the drawings. The invention is not limited by the embodiment.

Embodiment 1

Figure 2:
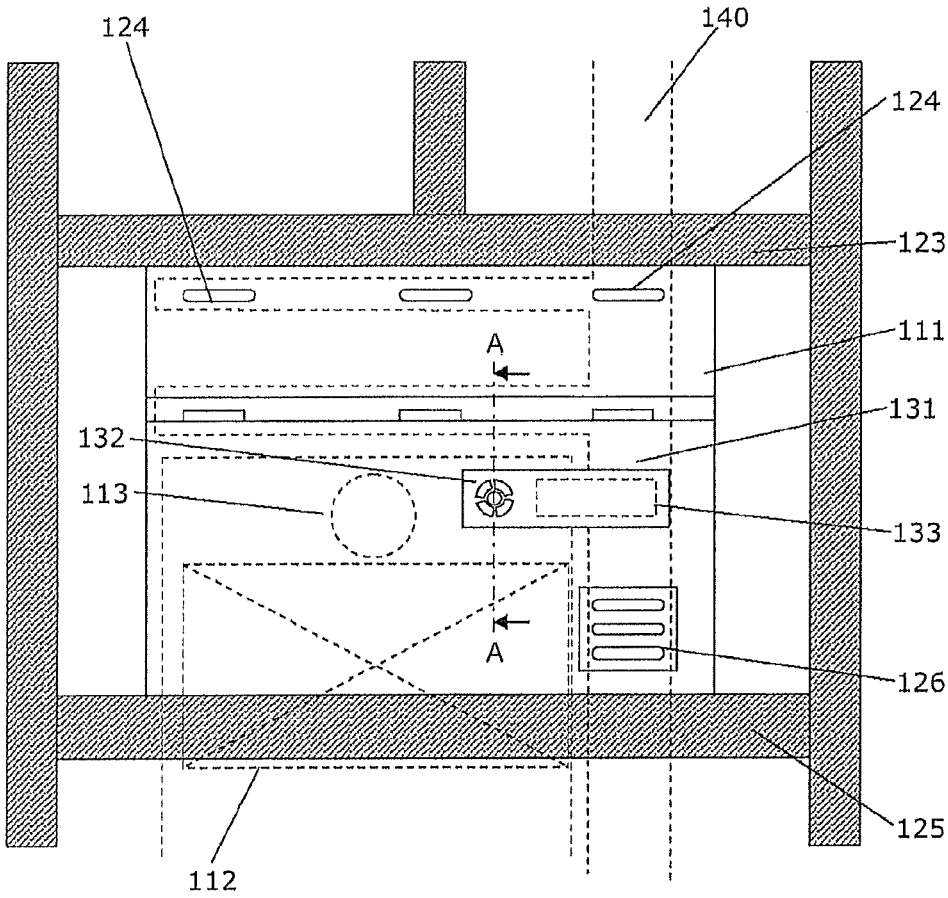
FIG. 2 is a principal front view of a vegetable compartment and the peripheral area of the refrigerator in Embodiment 1 of the present invention.
Figure 3:
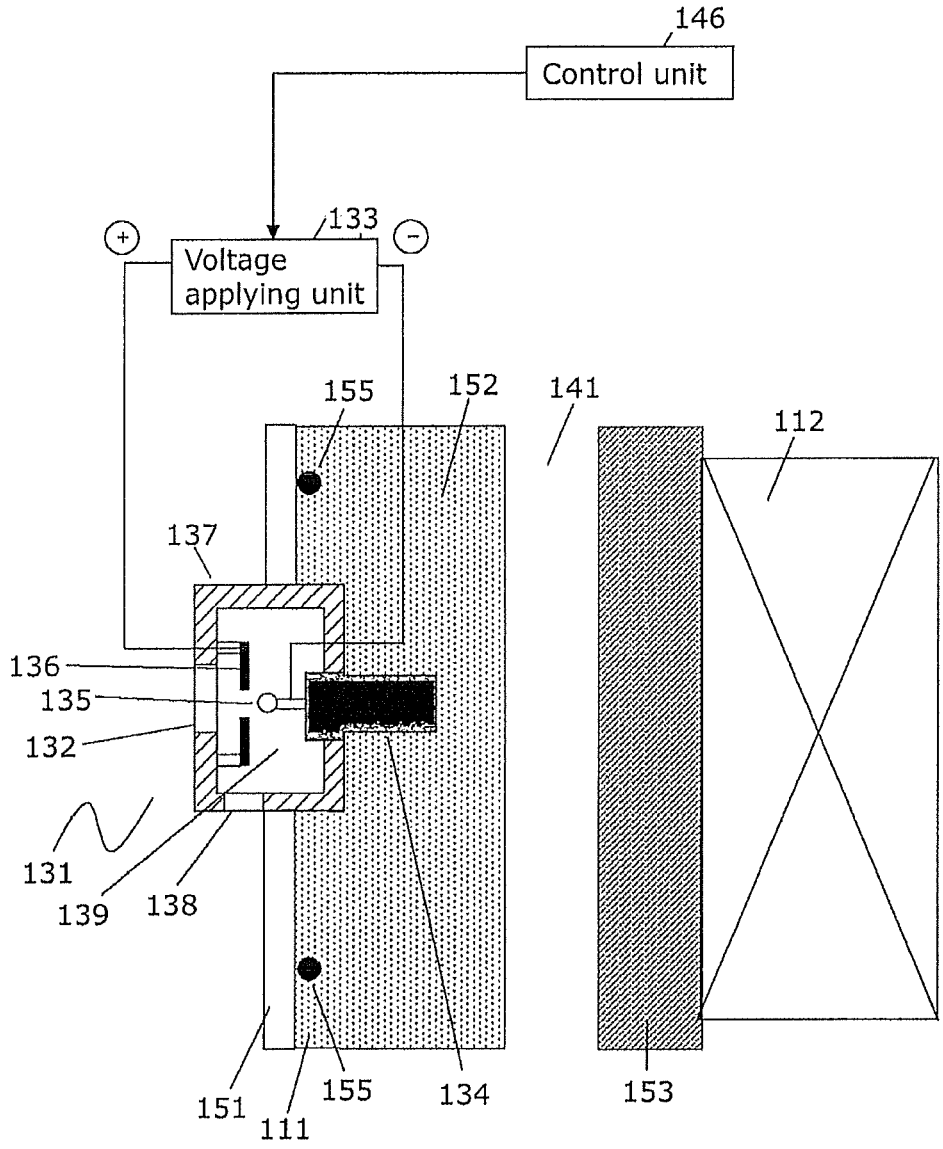
FIG. 3 is a sectional view taken along line A-A of FIG. 2 of the refrigerator in Embodiment 1 of the present invention.
Figure 4:
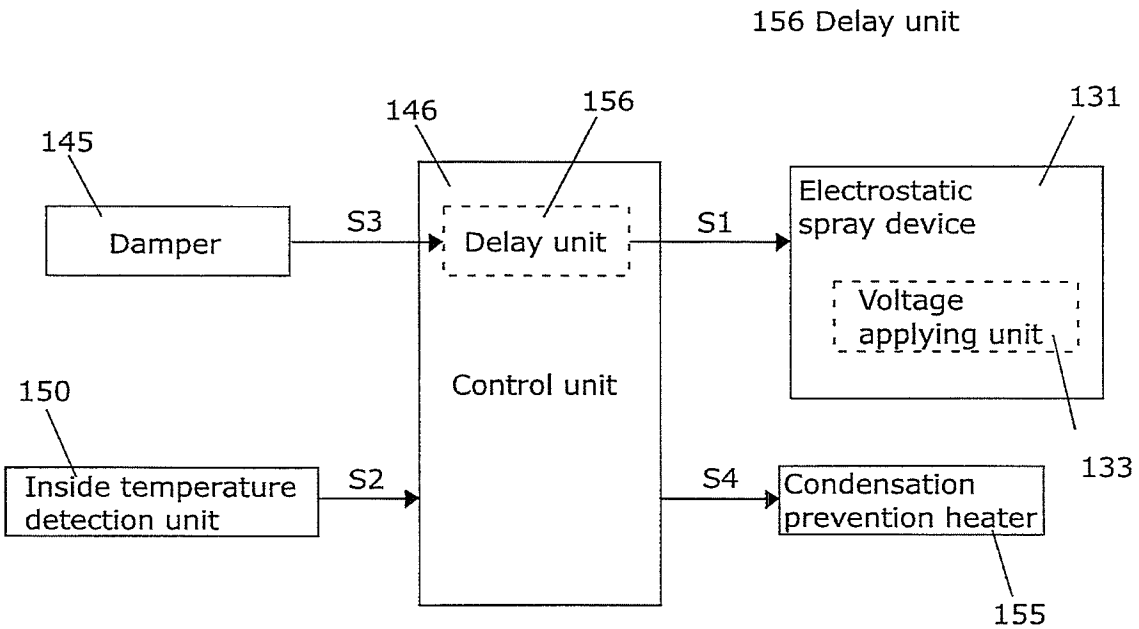
FIG. 4 is a functional block diagram of the refrigerator in Embodiment 1 of the present invention.
Figure 5:
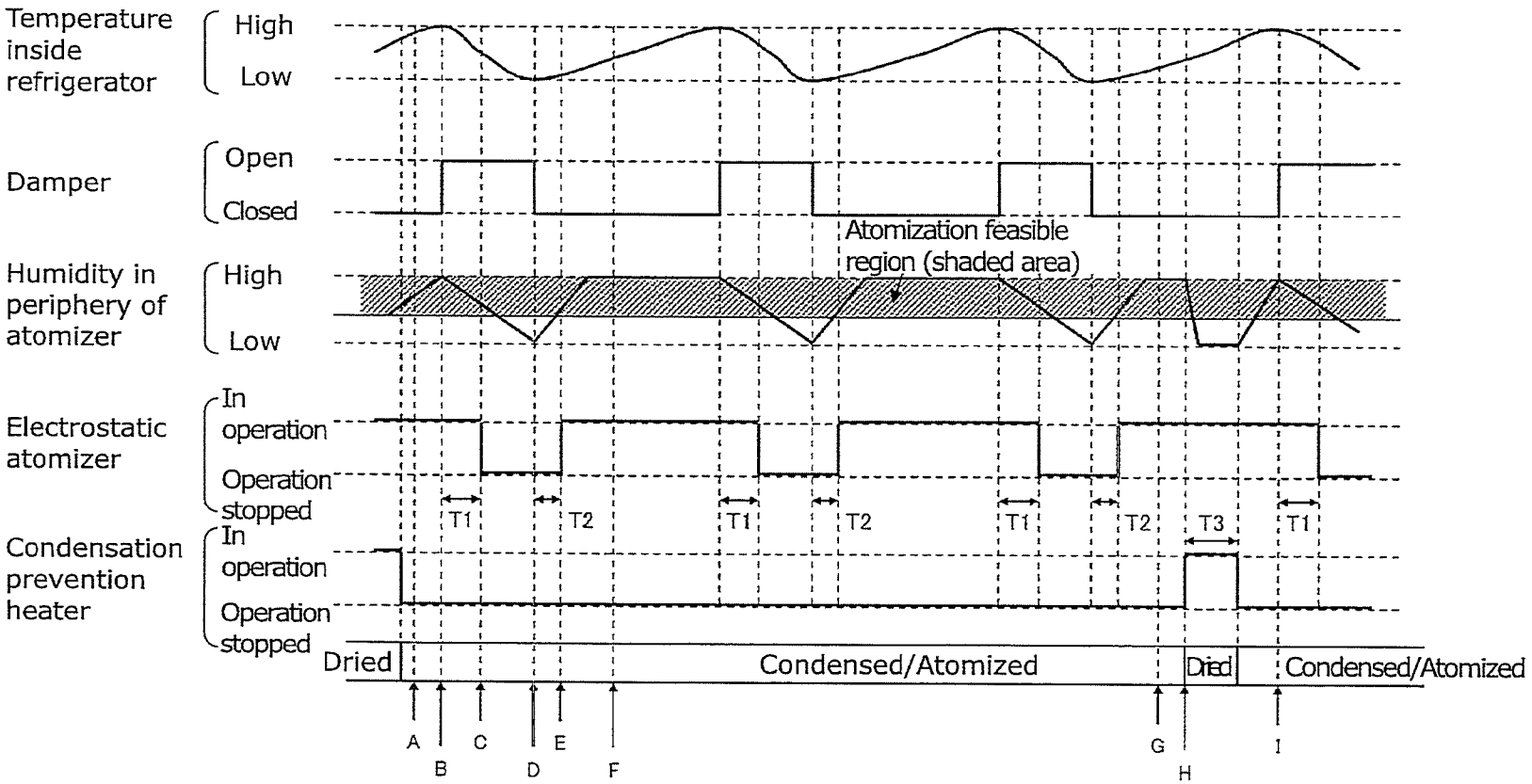
FIG. 5 is an operation timing chart of the refrigerator in Embodiment 1 of the present invention.
Figure 6:
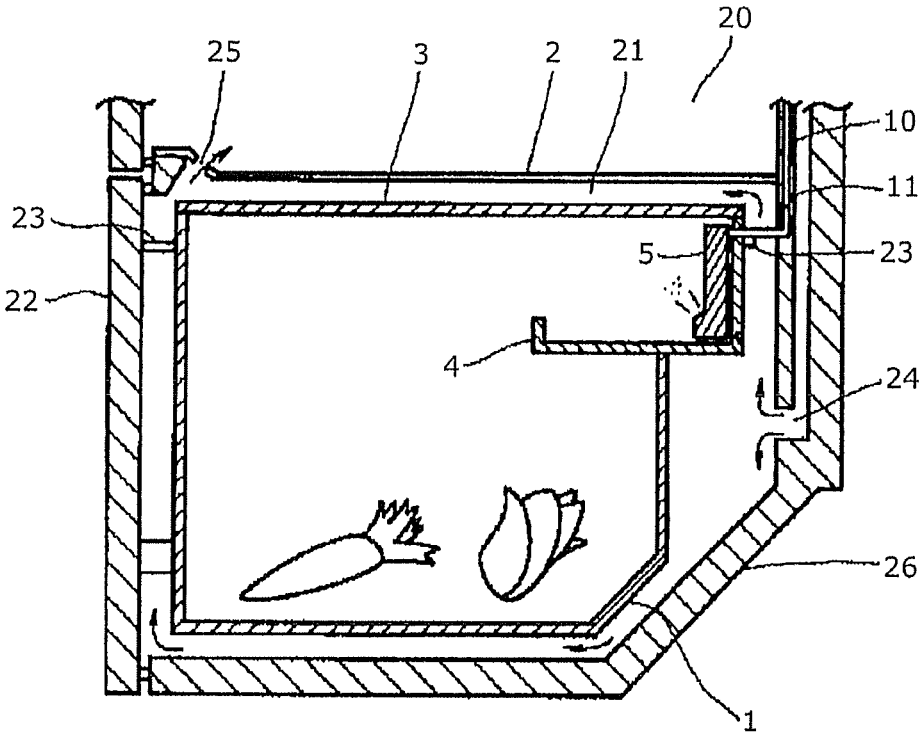
FIG. 6 is a vertical sectional view of a vegetable compartment of a conventional refrigerator.
Figure 7:
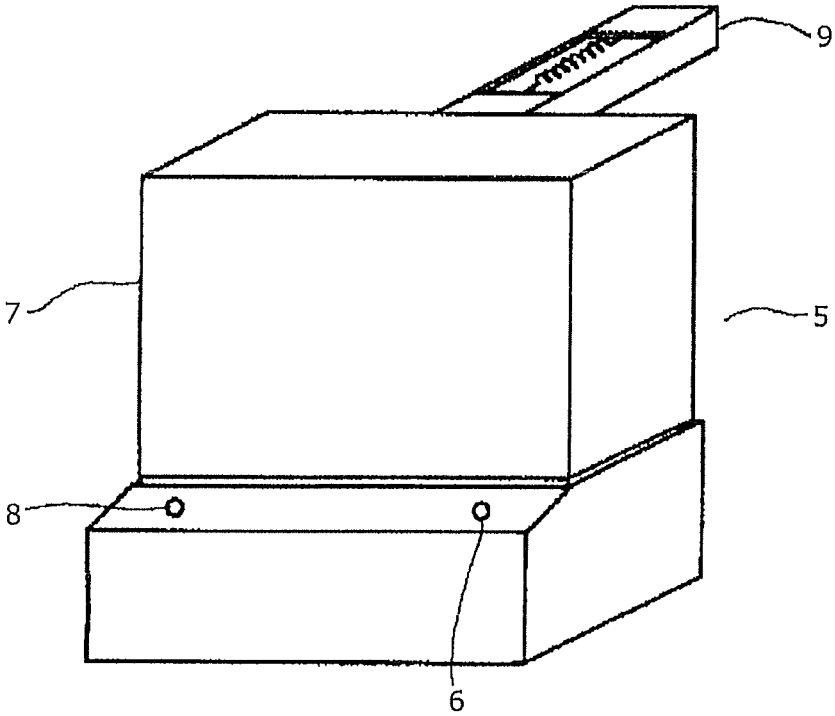
FIG. 7 is a principal enlarged perspective view of an ultrasonic atomizing device provided in the vegetable compartment of the conventional refrigerator.

FIG. 1 is a vertical sectional view of a refrigerator in Embodiment 1 of the present invention; FIG. 2 is a principal front view of a vegetable compartment and the peripheral area of the refrigerator in Embodiment 1 of the present invention; FIG. 3 is a sectional view taken along line A-A of FIG. 2 of the refrigerator in Embodiment 1 of the present invention; FIG. 4 is a functional block diagram of the refrigerator in Embodiment 1 of the present invention; and FIG. 5 is an operation timing chart of the refrigerator in Embodiment 1 of the present invention.

In FIGS. 1 to 4, a heat-insulating main body 101 of a refrigerator 100 includes an outer body 102 principally made of steel sheet, an inner body 103 molded with a resin such as ABS, and foam, e.g., foamed heat insulation material such as hard urethane foam, for filling the space between the outer body 102 and the inner body 103. Thus, the heat-insulating main body 101 is thermally insulated from the periphery and is partitioned into a plurality of storage compartments.

A configuration is made such that a refrigerator compartment 104 as a second storage compartment is disposed at the top portion of the heat-insulating main body 101; a changing compartment 105 as a fourth storage compartment, and an icemaker compartment 106 as a fifth storage compartment are disposed side-by-side below the refrigerator compartment 104; a vegetable compartment 107 as a first storage compartment is disposed below the switchable compartment 105 and the icemaker compartment 106; and a freezer compartment 108 as a third storage compartment is disposed at the lowest portion.

The refrigerator compartment 104 is normally set at a temperature of 1 to 5° C. whose lower limit does not cause freezing because of refrigeration preservation. The vegetable compartment 107 is set at a temperature of 2 to 7° C. which is equivalent to or slightly higher than the temperature of the refrigerator compartment 104. The freezer compartment 108 is set at a temperature in a freezing temperature range, i.e., normally in a range of −22 to −15° C. for preservation by freezing. However in order to improve freezing preservation quality, the freezer compartment 108 may be set at a low temperature of −30 to −25° C., for example.

The switchable compartment 105 can switch the temperature range to a predetermined temperature range between the refrigeration temperature range and the freezing temperature range, in addition to the refrigeration temperature range of 1 to 5° C., the temperature range for vegetables of 2 to 7° C., and the freezing temperature range of −22 to −15° C. The switchable compartment 105 is a storage compartment having an independent door, and is installed by the side of the icemaker compartment 106, and the independent door is often a drawer-type door.

In the present embodiment, the switchable compartment 105 covers switchable temperature ranges including the refrigeration temperature range and the freezing temperature range. However, the switchable compartment 105 may be a storage compartment for specific use of switching to the above-mentioned temperature range between the refrigeration temperature range and the freezing temperature range, under the condition that refrigeration is performed in the refrigerator compartment 104 and the vegetable compartment 107, and freezing is performed in the freezer compartment 108. Alternatively, the switchable compartment 105 may be a storage compartment whose temperature range is fixed to specific temperature range.

The icemaker compartment 106 makes ice by an automatic ice machine (not shown) provided at the upper portion of the icemaker compartment 106, using the water sent from the water storage tank (not shown) in the refrigerator compartment 104, and stores the ice in an ice storage container (not shown) disposed at the lower portion of the icemaker compartment 106.

The top of the heat-insulating main body 101 has a step-like recess in the direction to the back of the refrigerator 100. A machine chamber 101*a* is formed in the step-like recess which stores a compressor 109, and the components in the high voltage side of refrigeration cycle, such as a dryer (not shown) for removing water content. That is to say, the machine chamber 101*a* which stores the compressor 109 is formed by embedding in the rear area of the uppermost portion of the refrigerator compartment 104.

The matters related to the essence of the invention described hereinafter in the present embodiment may be applied to a typical, conventional refrigerator, in which a machine chamber is provided in the rear area of a storage compartment at the lowest portion of the heat-insulating main body 101, and the compressor 109 is disposed in the machine chamber. Alternatively, the refrigerator 100 may have what is called a mid-freezer configuration, in which the installment positions of the freezer compartment 108 and the vegetable compartment 107 are replaced.

Next, the back side of the vegetable compartment 107 and the freezer compartment 108 is provided with a cooling chamber 110 which generates cold air. A back side partition wall 111 is formed between the vegetable compartment 107 and the cooling chamber 110, and/or between the freezer compartment 108 and the cooling chamber 110. The back side partition wall 111 forms a carrier air passage for flowing cold air to each compartment, and further has heat insulating property in to thermally insulate each compartment from the cold air.

A cooler 112 is disposed in the cooling chamber 110, and a cooling fan 113 is disposed in the upper space of the cooler 112. The cooling fan 113 has a function of forcibly circulating the cold air which is cooled by the cooler 112. Specifically, the cooling fan 113 is a fan that sends the cold air cooled by the cooler 112 to the refrigerator compartment 104, the switchable compartment 105, the icemaker compartment 106, the vegetable compartment 107, and the freezer compartment 108. A heater 114 is disposed in the lower space of the cooler 112. In the case of the present embodiment, the heater 114 is a radiant heater which is made of glass tube, and defrosts the frost and ice adhering to the cooler 112 and its periphery. A drain pan 115 for receiving defrosted water produced at the time of defrosting is disposed at the lower portion of the heater 114. A drain tube 116 is connected from the backmost portion of the drain pan 115 to the outside of the refrigerator 100. An evaporation pan 117 is disposed outside the refrigerator 100 downstream of the drain tube 116.

In the vegetable compartment 107, there are disposed a lower storage container 119 which is placed on a frame attached to the drawer door 118 of the vegetable compartment 107, and an upper storage container 120 which is placed on the lower storage container 119. In the vegetable compartment 107, a lid 122 for substantially sealing the upper storage container 120 is disposed with the drawer door 118 closed. In the case of the present embodiment, the lid 122 is supported by a first partition 123 and the inner body 103 which are provided above the vegetable compartment 107. The lid 122 is in close contact with the right and left sides and the back side of the upper surface of the upper storage container 120. In addition, the lid 122 is in substantially contact with the front side of the upper surface of the upper storage container 120. Furthermore, the boundary space between the right and left lower sides of the back surface of the upper storage container 120 and the lower storage container 119 is reduced in a range so that the moisture in the food storage does not escape, the range keeping the upper and lower containers from contact with each other when the upper storage container 120 is in use.

The space between the lid 122 and the first partition 123 serves as an air passage for passing cold air. The air passage allows cold air to flow, the cold air being discharged from an outlet port 124 for the vegetable compartment 107, the outlet port 124 being formed in the back side partition wall 111. There is also a space provided between the lower storage container 119 and a second partition 125 below the lower storage container 119, and the space serves as an air passage for passing cold air. The lower portion of the back side partition wall 111 disposed on the rear surface side of the vegetable compartment 107 is provided with an inlet port 126 for the vegetable compartment 107, the inlet port 126 serving as a port for cold air to return to the cooler 112, the cold air having cooled the inside of the vegetable compartment 107 and having undergone heat exchange.

The matters related to the essence of the invention described hereinafter in the present embodiment may be applied to a typical, conventional refrigerator whose door is opened or closed by a frame attached to the door and a rail provided in the inner body.

The back side partition wall 111 is a member which thermally insulates the air passage, the cooling chamber 110 from the vegetable compartment 107. In the case of the present embodiment, the back side partition wall 111 forms the back wall of the vegetable compartment 107, and includes a heat insulation portion 152 having insulation property, and a surface portion 151 disposed on the surface of the heat insulation portion 152. The surface portion 151 is composed of resin such as ABS which is relatively hard and allows surface design treatment. The heat insulation portion 152 is composed of low thermally conductive resin with low density such as styrofoam in order to secure the insulation property.

An electrostatic spray device 131 is embedded in the back side partition wall 111, the electrostatic spray device 131 having an atomizing unit 139 which electrostatically atomizes water content. Specifically, a recess portion is provided on the back side partition wall 111 between the vegetable compartment 107 and the cooling chamber 110, and the spray device 131 is installed in the recess. By providing the recess portion in the back side partition wall 111, the space in the recess portion has low insulation property, and thus the temperature in the recess portion becomes lower than that in other portions in the vegetable compartment 107.

The thickness of part of the heat insulation portion 152 where a cooling pin 134 of the back side partition wall 111 is disposed is 10 mm or less. Accordingly, especially the cooling pin 134 is cooled, and the temperature thereof becomes lower than that in the vegetable compartment 107.

A condensation prevention heater 155 is embedded in the back side partition wall 111. The condensation prevention heater 155 is located in a neighborhood of the recess, i.e., where the spray device 131 is embedded, and between the surface portion 151 and the heat insulation portion 152.

A cover 153 is provided in front of the cooler 112, and in the back of the vegetable compartment 107, a discharge air passage 141 of the freezer compartment 108 is provided between the cover 153 and the back side partition wall 111.

In the air passage formed in the back of the heat insulation portion 152, there is provided a damper 145 for adjusting a circulation amount of the cold air which cools each storage compartment.

The spray device 131 includes an atomizing unit 139, a voltage applying unit 133, and a case 137. The case 137 is provided with an atomizing port 132 and a supply port 138 for supplying water content such as moisture to the case 137. The atomizing unit 139 includes a counter electrode 136 and an atomizing electrode 135. The atomizing electrode 135 is attached to the cooling pin 134. The cooling pin 134 is composed of high thermally conductive member such as aluminum or stainless steel. The atomizing electrode 135 and the cooling pin 134 are disposed so as to secure high thermal conduction therebetween.

The cooling pin 134 is fixed to the case 137 in such a manner that a portion of the cooling pin 134 projects outwardly from the case 137. The counter electrode 136 is an electrode in a doughnut disk shape (ring shape) on the vegetable compartment 107 side with respect to the location of the counter electrode 136 that faces the atomizing electrode 135. The counter electrode 136 is attached to the case 137 so as to be spaced apart from the atomizing electrode 135 by a certain distance. The central axis of the hole in the counter electrode 136 is aligned with the central axis of the atomizing port 132, and the tip end of the atomizing electrode 135 is disposed on the central axis. In the present embodiment, the counter electrode 136 is in a flat doughnut disk shape, but may be in a dome shape with an opening in the center so that the end of the atomizing electrode 135, and the surface of the counter electrode 136 that faces the end of the atomizing electrode 135 are spaced apart by the same distance. By adopting the above-mentioned shape to the counter electrode 136, efficiency of spraying mist can be improved.

In addition, the spray device 131 includes the voltage applying unit 133 for applying a voltage on a connection between the counter electrode 136 and the atomizing electrode 135. In the case of the present embodiment, the voltage applying unit 133 is disposed in a neighborhood of the atomizing unit 139. The voltage applying unit 133 has two electrodes for applying a voltage, the negative potential side of which is electrically connected to atomizing electrode 135, while the positive potential side of which is electrically connected to the counter electrode 136. For example, a negative high potential lower than a reference potential, in a range of −10 to −4 kV is applied to the atomizing electrode 135, while the counter electrode 136 is connected to a reference potential GND, and thus a high voltage is applied to the counter electrode 136.

The voltage applying unit 133 is configured to acquire a signal S1 from a delay unit 156 in a control unit 146 of the refrigerator 100, and to be able to set the high voltage ON/OFF. The operation of the electrostatic spray device 131 is controlled by ON/OFF of the voltage applying unit 133.

The control unit 146 acquires a signal S2 from an inside temperature detection unit 150, and a signal S3 from the damper 145 to control start/stop of the spray device 131, the signal S2 for detecting a temperature inside the refrigerator compartment 104 which is the second storage compartment of the refrigerator 100, and the signal S3 for adjusting an amount of cooling and an air flow. The control unit 146 also controls start/stop of the condensation prevention heater 155 for drying the atomizing electrode 135. A signal S4 is used for the control.

Hereinafter, the operation and effect of the refrigerator as configured in this manner is described.

First, the operation of a refrigeration cycle is described. The refrigeration cycle starts to operate and a cooling operation is performed based on a signal from a control substrate (not shown) according to a temperature setting in the refrigerator. The high temperature, high pressure coolant discharged by the operation of the compressor 109 is condensed and liquefied to a certain degree by a condenser (not shown), and is further condensed and liquefied while flowing through a refrigerant piping (not shown) disposed in the lateral surfaces or the rear surface of the refrigerator 100, or the front frontage of the refrigerator 100, and preventing condensation of the refrigerator 100, and finally reaches a capillary tube (not shown). Subsequently, in the capillary tube, the coolant is decompressed while exchanging heat with a suction pipe (not shown) to the compressor 109, and becomes low temperature, low pressure liquid coolant, and reaches the cooler 112.

The low temperature, low pressure liquid coolant exchanges heat with the air in each storage compartment such as the air in the discharge air passage 141 of the freezer compartment 108, the air being transported by the operation of the cooling fan 113, and thus the coolant in the cooler 112 is vaporized. At this point, cold air for cooling each storage compartment in the cooling chamber 110 is generated.

The low temperature cold air generated in the cooling chamber 110 is sent to the refrigerator compartment 104, the switchable compartment 105, the icemaker compartment 106, the vegetable compartment 107, and the freezer compartment 108 by cooling fan 113.

The cold air is shunted using the structure of the air passage and the damper 145, and is sent to each compartment so as to maintain the desired temperature range of the compartment.

The amount of cooling air for the refrigerator compartment 104 is adjusted by the damper 145 based on a temperature sensor (not shown) provided in the refrigerator compartment 104, and thus the refrigerator compartment 104 is cooled to a desired temperature. Particularly, the vegetable compartment 107 is adjusted at a temperature of 2 to 7° C. by an ON/OFF operation of distribution of the cold air and/or a heating unit (not shown).

In the vegetable compartment 107, there are disposed an outlet port 124 for the vegetable compartment 107, which discharges cold air, and an inlet port 126 which sucks the cold air in the vegetable compartment 107. The outlet port 124 is a port for discharging the cold air which has cooled the refrigerator compartment 104, and is disposed on the way of a return air passage to refrigerator compartment 140 for returning cold air to the cooler 112. The inlet port 126 is a port for sucking the cold air which has been discharged to the vegetable compartment 107, and has flown along the outer periphery of the upper storage container 120 and the lower storage container 119, and has cooled the inside of the upper storage container 120 and the lower storage container 119 in an indirect manner. The cold air sucked through the inlet port 126 for the vegetable compartment 107 is returned to the cooler 112.

The air passage and the cooling chamber 110 exist behind the back side partition wall 111 that is opposite side to the side where the spray device 131 is attached, and the cooling pin 134 of the spray device 131 which is nearest to the air passage and the cooling chamber 110 is strongly cooled by the cold air which is just generated in the cooler 112 by the operation of the cooling system. Specifically, the cold air which has been cooled by the cooler 112 and has reached a neighborhood of the cooling fan 113 has a temperature of approximately 25 to −15° C. The cold air passing through the air passage cools the cooling pin 134 at a temperature of approximately −10 to 0° C. by heat conduction at a thin portion of the heat insulation portion 152. At this time, because the cooling pin 134 is high thermally conductive member, the cooling pin 134 tends to transfer low heat, and also because the cooling pin 134 and the atomizing electrode 135 are connected to each other in a highly conductive state, the atomizing electrode 135 is also cooled at a temperature of approximately −10 to 0° C.

The vegetable compartment 107 is cooled so that the temperature thereof is maintained at a range of 2 to 7° C. And the vegetable compartment 107 is in a relatively high humidity condition because of the transpiration from vegetables and the like. Consequently, the atomizing electrode 135 which is cooled via the cooling pin 134 has a temperature below the dew point temperature, and thus water is generated and adheres to the atomizing electrode 135 including the tip end thereof which is the tip end for spraying.

The voltage applying unit 133 applies a high voltage across the atomizing electrode 135 and the counter electrode 136 (for example, the atomizing electrode 135 at −10 to −4 kV, the counter electrode 136 at GND), the atomizing electrode 135 to which water drops adhering being the negative voltage side, and the counter electrode 136 being the positive voltage side, and thus the operation of the spray device 131 starts.

At this point, a corona discharge occurs between the atomizing electrode 135 and the counter electrode 136, and the water drops (in the present embodiment, the water drops are what water content in the air condenses) adhering to the tip end for spraying of the atomizing electrode 135 is charged and made into minute particles by electrostatic energy. Further, because the water drops are electrically charged, the water drops become invisible microscopic mist with a minute electrical charge in the order of several nm because of Rayleigh fission. The microscopic mist contains ozone, OH radicals, oxygen radicals that are assumed to be generated by the above-mentioned corona discharge.

Although the difference in voltages applied to the electrodes is an extremely high voltage of 4 to 10 kV, the discharge current value at this moment is on the order of several μA, and the input is an extremely low value of 0.5 to 1.5 W, and thus proper spraying is performed.

In this manner, the microscopic mist on the order of nano meter which is generated in the atomizing electrode 135 is sprayed outwardly from the atomizing unit 139. At this moment, an ion wind is generated and the air in the case 137 flows out from the atomizing unit 139. In this moment, the inside of the case 137 has negative pressure, and thus additional highly humid air flows into the atomizing unit 139 through the supply port which is provided on the side of the case 137. By repeating this cycle, the spray device 131 can spray mist continuously.

Furthermore, the generated microscopic mist reaches the inside of the lower storage container 119 with the ion wind. Because the mist contains extremely small particles, the mist easily diffuses, and thus the microscopic mist also reaches the upper storage container 120. The sprayed mist is generated by a high pressure discharge, and thus has a negative electrical charge.

In the vegetable compartment 107, especially green vegetable leaves, fruits, and the like out of vegetables and fruits are preserved, and these vegetables and fruits tend to wither because of their transpiration or transpiration while they are preserved. The vegetables and fruits which are preserved in the vegetable compartment 107 normally include those vegetables and fruits that have withered somewhat because of transpiration on the way home after their purchase or transpiration while they are preserved, and thus has a positive electrical charge. Thus, negatively charged mist tend to gather on the surfaces of vegetables, and accordingly freshness of the vegetables is enhanced.

In addition, the microscopic mist on the order of nano meter which has been sprayed from the spray device 131 and has adhered to the surfaces of the vegetables has ozone in addition to a negative electrical charge due to a great number of OH radicals contained in the mist. Consequently, the mist sprayed from the spray device 131 has antibacterial properties, disinfection properties, and the like, and thus freshness of the vegetables preserved in the storage compartment may be further improved. Additionally, by the negatively charged mist adhering to the surfaces of vegetables, toxic substances such as agricultural chemicals adhering to the surfaces of vegetables can come off or can be captured by the mist, and thus can be easily removed. Furthermore, an effect of removing agricultural chemicals due to oxidative decomposition can be achieved. In addition, by applying a stimulus of the mist to the vegetables, the antioxidant action occurs, and an effect of an increase of nutrients such as the amount of vitamin C is promoted.

The refrigerator compartment 104 is controlled to be in a desired temperature range by the damper 145 as described above. That is to say, when the refrigerator compartment 104 has a temperature higher than the desired temperature, the refrigerator compartment 104 is cooled by opening the damper 145 to introduce colder air. When the damper 145 is opened, relatively dry air which has cooled the refrigerator compartment 104 flows into the vegetable compartment 107 through the outlet port 124, and thus the vegetable compartment 107 is cooled. Thus, in the refrigerator 100 in the present embodiment, cold air does not directly flow into the vegetable compartment 107, and the damper 145 does not control the cold air, either. That is to say, the vegetable compartment 107 is disposed on the way of the return air passage to refrigerator compartment 140, along which the cold air which flows out from the refrigerator compartment 104 returns to the cooling chamber 110.

In the case where the environment in the vegetable compartment 107 has a high humidity, it can be considered that the atomizing electrode 135 has excessively condensed water. In this case, by utilizing the return air from the relatively dry refrigerator compartment 104 controlled by the damper 145, the excessively condensed water drops on the atomizing electrode 135 are dried, and an appropriate amount of condensed water is formed, and thus the atomizing electrode 135 is controlled to be in an atomization feasible state.

In general, compared with the cold air in the refrigerator compartment 104, the cold air in the vegetable compartment 107 has high humidity, and the cold air which flows in from the refrigerator compartment 104 is relatively dry air in the vegetable compartment 107, and thus the cold air which flows in from the refrigerator compartment 104 is used for drying the atomizing electrode 135 in the present embodiment.

That is to say, the air flow, the ambient temperature, and the dry state in the vegetable compartment 107 vary in accordance with the opening and closing of the damper 145 of the refrigerator compartment 104 located upstream of the vegetable compartment 107 in the air passage of cold air. Accordingly, it can be assumed that the opening and closing of the damper 145 which is provided upstream of the vegetable compartment 107 in the air passage causes the cold air flow to change, the cold air flow governing condensation and drying in the periphery of the atomizing unit 139 among the environmental changes typical to the storage compartment of the refrigerator 100. Thus, the opening and closing of the damper 145 are essential factors which have an influence on the periphery of the atomizing unit 139, i.e., condensation and drying in the atomizing electrode 135.

However, drying by the cold air at the time of opening of the damper 145 may not be able to sufficiently dry the excessively condensed water content of the atomizing electrode 135, and thus the condensation prevention heater 155 is energized regularly, and the atomizing electrode 135 is forcibly dried regularly. Accordingly, impracticability of atomization due to excessive condensation of the atomizing electrode 135 can be prevented.

Thus, the open and close operations of the damper 145 of the refrigerator compartment 104 located upstream of the vegetable compartment 107 is an essential timing which makes it possible to predict that the environment in the periphery of the vegetable compartment 107 and the atomizing unit 139 changes, particularly, the cold air flow in the periphery of the atomizing unit 139 changes. However, the opening and closing timing of the damper 145 does not immediately cause the humidity in a periphery of the atomizing unit 139 in the vegetable compartment 107 to change, and the humidity changes with a time lag. Consequently, ON/OFF of the high voltage is controlled by the voltage applying unit 133 with a prescribed time interval of delay from the open/close signal of the damper 145, the delay being made by the delay unit 156, and thus mist is sprayed efficiently in a humidity range of an atomization feasible region.

In the present embodiment, a configuration has been described, in which the spray device 131 is attached to the back side partition wall 111, however, as long as the cooling pin 134 can be cooled, the spray device 131 may be attached to the first partition wall 123 so that mist can be sprayed from the top surface of the vegetable compartment 107. In this case, the spray device 131 can be easily installed in a structural sense by changing the shape of the cooling pin 134 from a rod-like shape to a plate-like shape, and slimming down the spray device 131.

Next, the content of control on the specific spray device 131 is described using the operation timing chart of FIG. 5.

First, in the operational state of the refrigerator 100 at the timing of point A of FIG. 5, the inside temperature detection unit 150 detects the temperature in the refrigerator compartment 104 which is the second storage compartment, and inputs a result of the detection to the control unit 146, the result of the detection being a signal S2. At this point, the control unit 146 has acquires a "closed state" signal from the damper 145, and determines that the inside temperature is not high based on the signal S2, and maintains the damper 145 in a closed state. That is to say, the refrigerator compartment 104 is not to cooled. Because the damper 145 is closed, dry cold air does not flow into the vegetable compartment 107, and thus the inside of the vegetable compartment 107 has a high humidity. The humidity in the periphery of the atomizing unit 139 is also in the atomization feasible region (shaded area (hatching area) in FIG. 5) in which the spray device 131 can atomize. Thus, the voltage applying unit 133 sets the high voltage ON, and sets the spray device 131 in an operation state so that the spray device 131 sprays microscopic mist from the atomizing electrode 135 into the vegetable compartment 107. During the time of spray, the condensation prevention heater 155 is in a stopped state, and is considered to be a normal condensation/atomization period of the atomizing electrode 135.

Next, at the timing of point B, the control unit 146 determines that the temperature in the refrigerator compartment 104 has become high, based on signal S2, and generates an open signal, and sets the damper 145 in an open state, and maintains the state. Accordingly, cold air flows into the refrigerator compartment 104 to cool the refrigerator compartment 104, while the open state signal (included in the signal S3) from the damper 145 is inputted to the control unit 146, and the open signal is inputted to the delay unit 156.

Thus, because the damper 145 is open, the dry cold air flows into the vegetable compartment 107, and thus the humidity in the vegetable compartment 107 starts to decrease. However, the humidity in a periphery of the atomizing unit 139 does not immediately decrease, and the operation of the spray device 131 continues for the prescribed time because the current humidity is in the atomization feasible region.

At the timing of point C after the prescribed time elapses, the damper 145 is in an open state, and thus the humidity in the vegetable compartment 107 and in a periphery of the atomizing unit 139 further decreases, and deviates from the atomization feasible region. At this timing, the delay unit 156 starts to count elapsed time from the moment (point B) when an open signal of the damper 145 is generated, and outputs a first signal (included in the signal S1) for controlling the operation of the spray device 131 when a predetermined first time period T1 elapses. When the spray device 131 acquires the first signal, the high voltage is set to OFF by the voltage applying unit 133, and the spray device 131 stops the operation. By previously defining the prescribed time for the first time period T1 between the time (point B) when the state of the damper 145 is changed from "close" to "open", and the time (point C) when the spray device 131 is stopped, atomization control can be performed without using a complicated humidity measurement method. For the value of T1 in this case, 10 to 15 minutes is preferable, but T1 may be experimentally prescribed freely in accordance with the cooling performance of the actually used refrigerator 100.

Next, at the timing of point D, the control unit 146 determines that the temperature in the refrigerator compartment 104 has become low, based on a result of the detection by the inside temperature detection unit 150, and generates a close signal, and sets the damper 145 in an closed state, and maintains the state. Accordingly, the refrigerator compartment 104 is not cooled, while the closed state signal (included in the signal S3) from the damper 145 is inputted to the control unit 146, and the close signal is inputted to the delay unit 156.

Thus, because the damper 145 is closed, no dry cold air flows into the vegetable compartment 107, and thus the humidity in the vegetable compartment 107 starts to increase. However, the humidity in a periphery of the atomizing unit 139 does not immediately increase, and the operation of the spray device 131 remains stopping for the prescribed time because the current humidity is out of the atomization feasible region.

Next, at the timing of point E after the prescribed time elapses, the damper 145 is in a closed state, and thus the humidity in the vegetable compartment 107 and in a periphery of the atomizing unit 139 further increases, and enters the atomization feasible region. Thus, at this timing, the delay unit 156 starts to count elapsed time from the moment when the close signal is generated, and outputs a second signal (included in the signal S1) for controlling the operation of the spray device 131 when a predetermined second time period T2 elapses. When the spray device 131 acquires the second signal, the high voltage is set to ON by the voltage applying unit 133, and the spray device 131 is set in operation. By previously defining the prescribed time for the second time period T2 between the time (point D) when the state of the damper 145 is changed from "open" to "close", and the time (point E) when the spray device 131 is started, atomization control can be performed without using a complicated humidity measurement method in a similar manner as in the case of the first time period T2. For the value of T2 in this case, 5 to 10 minutes is preferable, but T2 may be experimentally prescribed freely in accordance with the cooling performance of the actually used refrigerator 100.

Then in the condensation/atomization period between the timing of point F and the timing of point G, the above-described operation between point B and point E is repeated for two cycles, and efficient spraying of mist is continued.

Next, at the timing of point H, when the damper 145 is in a closed state and the spray device 131 is in operation, the humidity in a periphery of the atomizing unit 139 is also in an atomization feasible region, the atmosphere and the like of a periphery of the atomizing unit 139 is warmed by operating the condensation prevention heater 155. A drying time period T3 during which the condensation prevention heater 155 is operated is set between the current time and the timing of point I when the damper 145 is in an open state next time. Accordingly, even when the atomizing electrode 135 is in an excessive condensation state, the atomizing electrode 135 can be thoroughly dried, and thus mist can be smoothly sprayed subsequently. For the value of T3 in this case, approximately 10 minutes is preferable, but T3 may be experimentally prescribed freely in accordance with the thermally conductive performance of the actually used refrigerator 100. In this manner, the drying time period of the atomizing electrode 135 is periodically provided.

The delay unit 156 desirably set that the first period (T1)>= the second period (T2). This is because, in a storage compartment with high humidity like the vegetable compartment 107, the rate of decrease in the humidity after the damper 145 is opened is greater than the rate of increase in the humidity after the damper 145 is closed. In other words, the rate of humidity decrease in the first period is slow, and thus even when a longer first time period is set, spraying in a high humidity state can be performed, while the rate of humidity increase in the second period is fast, and thus even when a shorter second time period is set, spraying in a high humidity state can be performed.

In this manner, by setting the first time period to be equal to or longer than the second time period, spraying in a high humidity state can be performed, and thus the spray rate of the spray device 131 can be improved, which performs spraying to the peripheral air by using condensed water.

Furthermore, in the present embodiment, when mist is sprayed into a storage compartment of the refrigerator, the spray rate of mist of the spray device 131 is preferably 50% or more and 80% or less. This is because, in a low-temperature high humidity state like the state of a refrigerator, when a large quantity of mist is sprayed, mist on the wall surface is condensed, and thus a small quantity of mist is preferably sprayed for a long time. Therefore, in order to achieve a sufficient effect continuously with a small quantity of mist, the spray rate of 50% or more is required.

In the present embodiment, in order to stably supply a small quantity of mist, a drying time period of the atomizing electrode 135 is periodically provided. By setting the spray rate of 80% or less for operation states including a state in which the spray device is in operation, but spraying is not performed because of dry state, excessive condensation of the atomizing electrode 135 is suppressed, and thus reliable and stable spraying of mist can be achieved.

In the present embodiment, during a drying time period T3, even at the time of switching between condensation and dry time periods, the spray device 131 is set in operation in order to efficiently spray mist, however, the spray device 131 may be stopped to improve energy saving performance.

In the present embodiment, it has been described that the timing of energizing the condensation prevention heater 155 is once for every three cycles of the open and close operations of the damper 145. However, as long as the atomizing electrode 135 is thoroughly dried, the timing of the energization may be once for an arbitrary number of cycles.

As described above, the refrigerator in the present embodiment includes: the vegetable compartment 107 which is a thermally insulated storage compartment; the atomizing unit 139 for spraying mist into the vegetable compartment 107; the damper 145 disposed upstream of the vegetable compartment 107 in the air passage; the condensation prevention heater 155 for drying a periphery of the atomizing unit 139; and the control unit 146 for controlling the operation of the atomizing unit 139 using the open/close signals of the damper 145 as an input. By the control unit 146 having the delay unit 156 which controls the atomizing unit 139 by delaying an atomizing operation by a prescribed time with respect to the open/close signals of the damper 145, mist spraying operation is performed in an appropriate humidity state of the atomizing unit 139, which is in the atomization feasible region. Thus efficient, and appropriate atomization can be achieved, and fresh quality of vegetables may be further improved.

In this case, when the state of the damper 145 is changed from "open" to "closed", the spray device 131 is set in operation after a prescribed time elapses, while when the state of the damper 145 is changed from "closed" to "open", the spray device 131 is stopped after a prescribed time elapses.

As described above, in the present embodiment, for the open/close signals of the damper 145, i.e. for both of the opening signal and the closed signal, by delaying an atomizing operation by a prescribed time, the spray device 131 can be operated more efficiently in the actual operation of the refrigerator 100, efficient mist spraying can be achieved.

In this manner, appropriate atomization is achieved efficiently, and not only the quality of the refrigerator 100 provided with the spray device 131 is improved, but also the amount of power required to control the spray device 131 can be reduced to a low level.

When the timing of energizing the condensation prevention heater 155 is once for a plurality of cycles of the open and close operations of the damper 145, the number of times of energizing the condensation prevention heater 155 is reduced, and thus not only the power consumption can be further reduced, but also an increase of the temperature in the vegetable compartment 107 is suppressed, thereby allowing high quality food preservation.

The atomizer head 139 includes an electrostatic atomization system having the atomizing electrode 135 and the counter electrode 136, the atomizing electrode 135 being connected to a negative potential lower than a reference potential, and the counter electrode 136 being connected to the reference potential GND. By applying a high voltage by the voltage applying unit 133, microscopic mist on the order of nano meter, having negatively charged OH radicals is sprayed more efficiently than in the case where the atomizing electrode 135 is connected to the positive side rather than the reference potential GND. Therefore, an input power to the voltage applying unit 133 can be small, and thus miniaturization of the spray device 131 can be achieved, and mist spraying can be performed in less space.

In the present embodiment, the storage compartment for spraying mist in the refrigerator 100 is the vegetable compartment 107, but may be a storage compartment in other temperature range such as the refrigerator compartment 104 or the switchable compartment 105. In this case, various applications can be developed.

In the present embodiment, heat conduction from the air passage through which cold air flows is utilized for a cooling unit for cooling each storage compartment formed of the cooler 112, however, a cool unit using a Peltier element may also be considered.

INDUSTRIAL APPLICABILITY

As described above, the refrigerator according to one aspect of the present invention can achieve appropriate atomization in a storage compartment, and thus can be applied to not only a household or industrial refrigerator, or a refrigerator exclusively for vegetables, but also low-temperature distribution of food such as vegetables, or warehouse.

REFERENCE SIGNS LIST

100 Refrigerator
101 Heat-insulating main body
102 Outer case
107 Vegetable compartment (storage compartment)
109 Compressor
111 Back side partition wall
112 Cooler
113 Cooling fan
124 Outlet port for vegetable compartment
131 Electrostatic spray device
132 Atomizing port
133 Voltage applying unit
134 Cooling pin
135 Atomizing electrode
136 Counter electrode
139 Atomizing unit
145 Damper
155 Condensation prevention heater
156 Delay unit

The invention claimed is:

1. A refrigerator for circulating cold air which is a gas cooled in a cooling compartment, said refrigerator comprising:

a storage compartment partitioned with heat insulation;

a spray device configured to supply mist to said storage compartment;

a damper provided in an air passage for circulating the cold air from the cooling compartment to said storage compartment;

a control unit configured to control said spray device so that an operation of said damper and an operation of said spray device are coordinated; and a delay unit configured to command said control unit to stop the operation of said spray device after an elapse of a first time period since said damper is opened.

2. The refrigerator according to claim 1, wherein said delay unit is configured to generate, based on an open signal issued when said damper is opened, a first signal for stopping the operation of said spray device after the elapse of the first time period, and said control unit is configured to stop the operation of said spray device based on the first signal.

3. The refrigerator according to claim 1, wherein said delay unit is configured to generate, based on a close signal issued when said damper is closed, a second signal for starting the operation of said spray device after the elapse of the second time period, and said control unit is configured to start the operation of said spray device based on the second signal.

4. The refrigerator according to claim 1, wherein said storage compartment includes:

a first storage compartment which is disposed on a way of the air passage and to which the mist is supplied, and a second storage compartment disposed upstream of said first storage compartment; and an inside temperature detection unit configured to detect a temperature of said second storage compartment, and said control unit is configured to generate the open signal when a result of the detection by said inside temperature detection unit exceeds a predetermined threshold range, and to generate the close signal when the result of the detection falls below the predetermined threshold range.

5. The refrigerator according to claim 1, further comprising a condensation prevention heater configured to dry a periphery of said spray device by heating, wherein said control unit is configured to cause said condensation prevention heater to operate for a predetermined drying period until the close signal is received when said damper is in a closed state and said spray device is in operation based on the close signal and the second signal.

6. The refrigerator according to claim 5, wherein said control unit is configured to cause said condensation prevention heater to operate in one of a plurality of occurrences of a situation in which said damper is in a closed state and said spray device is in operation.

7. The refrigerator according to claim 1, wherein said spray device includes:

a thin rod-shaped atomizing electrode;

a counter electrode which is disposed so as to oppose and be spatially apart from said atomizing electrode; and a voltage applying unit configured to apply a voltage across said atomizing electrode and said counter electrode with said atomizing electrode at a negative potential and said counter electrode at a reference potential.

8. The refrigerator according to claim 2, wherein said storage compartment includes:

a first storage compartment which is disposed on a way of the air passage and to which the mist is supplied, and a second storage compartment disposed upstream of said first storage compartment; and an inside temperature detection unit configured to detect a temperature of said second storage compartment, and said control unit is configured to generate the open signal when a result of the detection by said inside temperature detection unit exceeds a predetermined threshold range, and to generate the close signal when the result of the detection falls below the predetermined threshold range.

9. The refrigerator according to claim 3, wherein said storage compartment includes:

a first storage compartment which is disposed on a way of the air passage and to which the mist is supplied, and a second storage compartment disposed upstream of said first storage compartment; and an inside temperature detection unit configured to detect a temperature of said second storage compartment, and said control unit is configured to generate the open signal when a result of the detection by said inside temperature detection unit exceeds a predetermined threshold range, and to generate the close signal when the result of the detection falls below the predetermined threshold range.

10. A refrigerator for circulating cold air which is a gas cooled in a cooling compartment, said refrigerator comprising:

a storage compartment partitioned with heat insulation;

a spray device configured to supply mist to said storage compartment;

a damper provided in an air passage for circulating the cold air from the cooling compartment to said storage compartment;

a control unit configured to control said spray device so that an operation of said damper and an operation of said spray device are coordinated; and a delay unit configured to command said control unit to start the operation of said spray device after an elapse of a second time period since said damper is closed.

11. The refrigerator according to claim 10, wherein said storage compartment includes:

a first storage compartment which is disposed on a way of the air passage and to which the mist is supplied, and a second storage compartment disposed upstream of said first storage compartment; and an inside temperature detection unit configured to detect a temperature of said second storage compartment, and said control unit is configured to generate the open signal when a result of the detection by said inside temperature detection unit exceeds a predetermined threshold range, and to generate the close signal when the result of the detection falls below the predetermined threshold range.

12. A method of refrigeration comprising:

spraying mist into a first storage compartment by a spray device which utilizes an electrostatic atomization system, the first storage compartment being disposed on a way of an air passage which is a passage for forcibly circulating cold air which is a gas that has been cooled in a cooling compartment;

opening the air passage upstream of the first storage compartment by a damper; and stopping an operation of the spray device after an elapse of a first time period since the damper is opened.

13. The method of refrigeration according to claim 12, further comprising charging the mist negatively.

14. A method of refrigeration comprising:

spraying mist into a first storage compartment by a spray device which utilizes an electrostatic atomization system, the first storage compartment being disposed on a way of an air passage which is a passage for forcibly circulating cold air which is a gas that has been cooled in a cooling compartment;

closing the air passage upstream of the first storage compartment by a damper; and starting an operation of said spray device after an elapse of a second time period since the damper is closed.

15. The method of refrigeration according to claim 14, further comprising charging the mist negatively.

* * * * *